US006227681B1

(12) United States Patent
Shoemaker et al.

(10) Patent No.: US 6,227,681 B1
(45) Date of Patent: May 8, 2001

(54) LIGHT FIXTURE RELAMPING DEVICE

(75) Inventors: David Charles Shoemaker; Christopher Michael Bryant, both of Vicksburg, MS (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/305,319

(22) Filed: May 5, 1999

(51) Int. Cl.[7] ..... F21V 21/26
(52) U.S. Cl. ..... 362/269; 362/287; 362/427
(58) Field of Search ..... 362/269, 295, 362/282, 285, 287, 418, 427, 429, 430

(56) References Cited

U.S. PATENT DOCUMENTS

D. 349,777 * 8/1994 Kelly et al. ..... D26/63
1,882,185 * 10/1932 Graham ..... 362/275
4,323,953 * 4/1982 Hutchison ..... 362/223
4,410,933 * 10/1983 Blake et al. ..... 362/371
4,547,841 * 10/1985 Quiogue ..... 362/269
5,205,645 * 4/1993 Lee ..... 362/431
5,548,500 * 8/1996 MacKay ..... 362/427
5,690,419 * 11/1997 Siems ..... 362/269

OTHER PUBLICATIONS

Musco Lighting Catalog; Light–Structure System; 1998.*
Sportsliter Solutions; Hubbel Lighting, Inc.; 1998.*

* cited by examiner

*Primary Examiner*—Y. Quach
(74) *Attorney, Agent, or Firm*—Fish & Richardson PC

(57) ABSTRACT

A floodlight fixture includes a base, a reflector assembly, an aiming mechanism coupled between the base and the reflector assembly, and a relamping mechanism coupled between the base and the reflector assembly. The aiming mechanism permits movement of the reflector assembly relative to the base to aim the reflector assembly and includes a locking mechanism used to fix a configuration of the aiming mechanism. The relamping mechanism permits movement of the reflector assembly between an aimed position and a relamping position without manipulating the locking mechanism to affect the configuration of the aiming mechanism.

20 Claims, 10 Drawing Sheets

LIGHT FIXTURE RELAMPING DEVICE

TECHNICAL FIELD

The invention relates to relamping a light fixture.

BACKGROUND

Floodlights may be used to illuminate a large area, such as a sports field. The floodlights typically are mounted in an array and attached to a cage that is then elevated and mounted on a pole or lighting stand. Each floodlight then is aimed at a position on the field to provide desired total illumination of the field. The cage has a walkway behind the floodlights for use by service personnel in accessing the lights.

To relamp a conventional floodlight from the walkway behind the array, a service person may reach around the array to access the lamp. This offers considerable risk of falling, or of dropping the lamp.

As an alternative, the service person may turn the floodlight away from the field to access the lamp, replace the lamp, and return the floodlight back to being aimed at the field. This procedure risks losing the desired aiming of the floodlight once it is returned to being aimed at the field.

U.S. Pat. No. 4,410,933 describes one attempt to solve this problem by using a flat positioning plate against which the floodlight abuts when in the aimed position. The plate has an arcuate slot through which a screw extends to secure the plate to a bracket. This screw is loosened when initially aiming the floodlight so that the plate can be moved to accommodate the desired aiming of the floodlight. Once the floodlight is properly aimed and bolted in place, the screw is tightened to secure the plate in place. Thereafter, the floodlight may be relamped by loosening the bolts and moving the floodlight to a relamping position. The floodlight is then returned to its aimed position by moving the floodlight until it contacts the positioning plate.

SUMMARY

In one general aspect, a floodlight fixture includes a base, a reflector assembly, an aiming mechanism coupled between the base and the reflector assembly, and a relamping mechanism coupled between the base and the reflector assembly. The aiming mechanism permits movement of the reflector assembly relative to the base to aim the reflector assembly and includes a locking mechanism used to fix a configuration of the aiming mechanism. The relamping mechanism permits movement of the reflector assembly between an aimed position and a relamping position without manipulating the locking mechanism to affect the configuration of the aiming mechanism.

Embodiments may include one or more of the following features. For example, the relamping mechanism of the floodlight fixture may include at least one hinge plate and at least one mounting guide that includes a plate having a stop ledge perpendicular to the plate, a first end of the hinge plate being rotatably connected to the mounting guide. A second end of the hinge plate may be rotatably connected to the reflector assembly by an aiming bolt.

The mounting guide may be connected to a first end of an arm with a second end of the arm connected to the base so that the position of the arm relative to the base is fixed. The relamping mechanism may further include a second hinge plate connected to a second mounting guide, with the second mounting guide being connected to a first end of a second arm and a second end of the second arm being connected to the base.

The mounting guide may further include a pair of brackets mounted perpendicularly to the plate and positioned on a side opposite from the stop ledge and the brackets may surround a portion of the arm. The mounting guide may be connected to the hinge plate and arm by a lamping bolt that is loosenable to permit moving the reflector assembly between the aimed position and the relamping position. The bracket may be configured to fix the position of the mounting guide relative to the arm.

The hinge plate may rest against the stop ledge in the aiming position. The relamping mechanism may be configured to permit the rotation of the hinge plate in one direction when the hinge plate rests against the stop ledge. The position of the reflector assembly relative to the hinge plate may be the same in the aiming position and the relamping position. The reflector assembly may include a reflector and the aiming mechanism, and the aiming mechanism may include at least one socket. The aiming mechanism may further include an aiming sight including a slot and a tab mounted on the socket. The locking mechanism may include at least one aiming bolt and the aiming bolt may pass from a second end of the hinge plate into the socket.

In another general aspect, a method of changing a lamp in a floodlight fixture includes providing a floodlight fixture, moving the reflector assembly from the aiming position to the relamping position, changing the lamp, and returning the reflector assembly to the aiming position. The floodlight fixture includes a base, a reflector assembly, an aiming mechanism coupled between the base and the reflector assembly, and a relamping mechanism coupled between the base and the reflector assembly. The aiming mechanism permits movement of the reflector assembly relative to the base to aim the reflector assembly and includes a locking mechanism to fix a configuration of the aiming mechanism. The relamping mechanism permits movement of the reflector assembly between an aimed position and a relamping position without manipulating the locking mechanism to affect the configuration of the aiming mechanism. The position of each hinge plate relative to the reflector assembly in the aiming position is the same after lamping as it was before lamping.

The floodlight fixture provides considerable advantages, such as the ability to relamp without losing the aiming of the floodlight fixture or reaching around the array of floodlights, thereby reducing the risk that the service person may drop the lamp or fall from the cage. In addition, relamping is accomplished without manipulating the fixture's aiming bolts, which eliminates any chance of affecting aiming as a result of relamping.

Other features and advantages will be apparent from the following description, including the drawings, and from the claims.

DESCRIPTION

Figure 1:
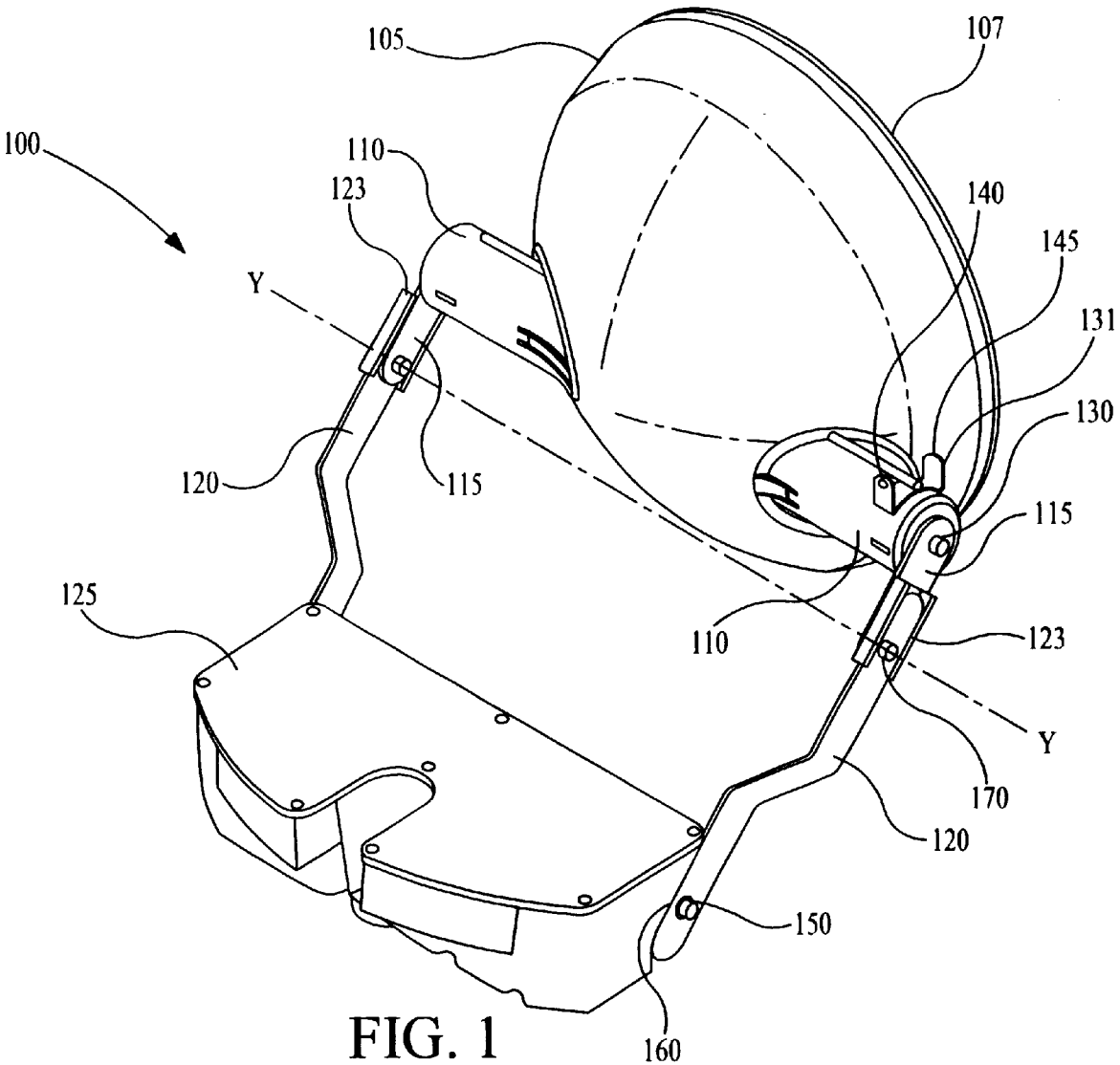
FIG. 1 is a perspective view of a floodlight fixture in an aimed position.
Figure 2:
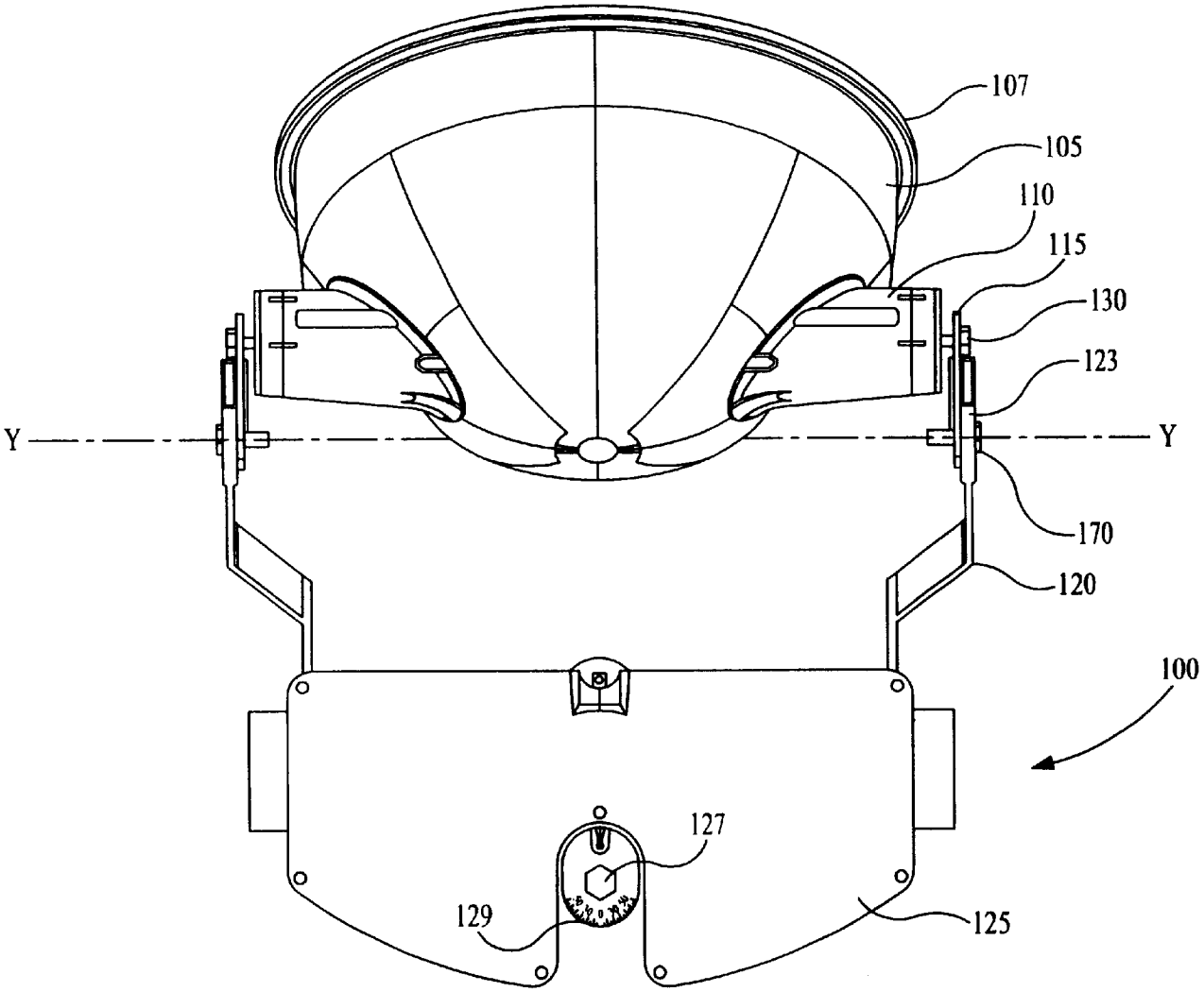
FIG. 2 is a top view of the fixture of FIG. 1.

Referring to FIGS. 1 and 2, a sports floodlight fixture 100 in an aiming position includes a reflector 105 having a face 107, a pair of connection sockets 110, a pair of hinge plates 115, a pair of arms 120, a pair of mounting guides 123, and an aiming base 125. The base 125 is rotatable about an axis of a connection bolt 127 (FIG. 2) to permit aiming of the reflector relative to that axis. The base includes an angle indicator 129 for use in monitoring the rotational position of the base 125.

The arms 120 extend from the base 125. The mounting guides 123 are secured to ends of the arms 120. The hinge plates 115 are rotatably connected to the ends of the arms 120. The mounting guides 123 ensure that the hinge plates 115 may be positioned in a fixed, known configuration relative to the arms 120.

The connection sockets 110 are coaxial, extend from the reflector, and are rotatably mounted to the hinge plates 115 by a pair of aiming bolts 130. The orientation of the reflector 105 relative to the hinge plates 115 (and the arms 120) can be varied by loosening the aiming bolts 130, which pass through the hinge plates into the sockets 110. The position of the reflector 105 is varied to permit aiming of the reflector at a target, such as an area of a sports field.

An aiming sight 135 is positioned on one of the sockets and is used to aim the reflector. The aiming sight includes a slot 140 and a tab 145. To aim the reflector at a particular location, the user rotates the reflector 105 while looking at a particular location until the tab 145 visually fits within the slot 140 while the user is looking at the particular location. The user then tightens the aiming bolts 130 to fix the aim of the floodlight.

Figure 3:
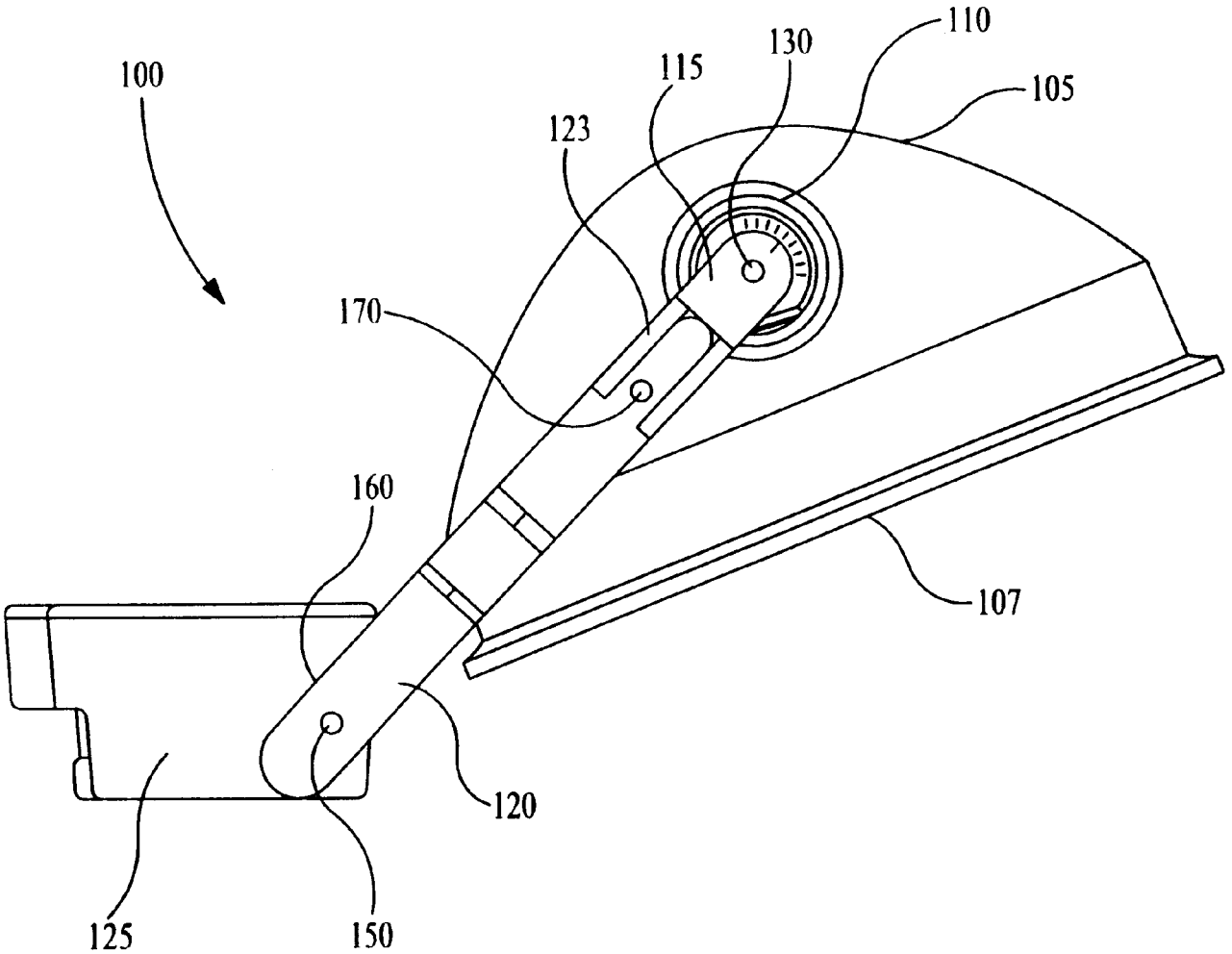
FIG. 3 is a side view of the fixture of FIG. 1 in which the aiming position has been changed.

Referring also to FIG. 3, the reflector 105 may be aimed to be directed at a different location than that at which the reflector was aimed in FIGS. 1 and 2 by loosening bolts 130. Again, once the floodlight's aiming is at the desired location, bolts 130 are tightened to fix the aim.

Figure 4:
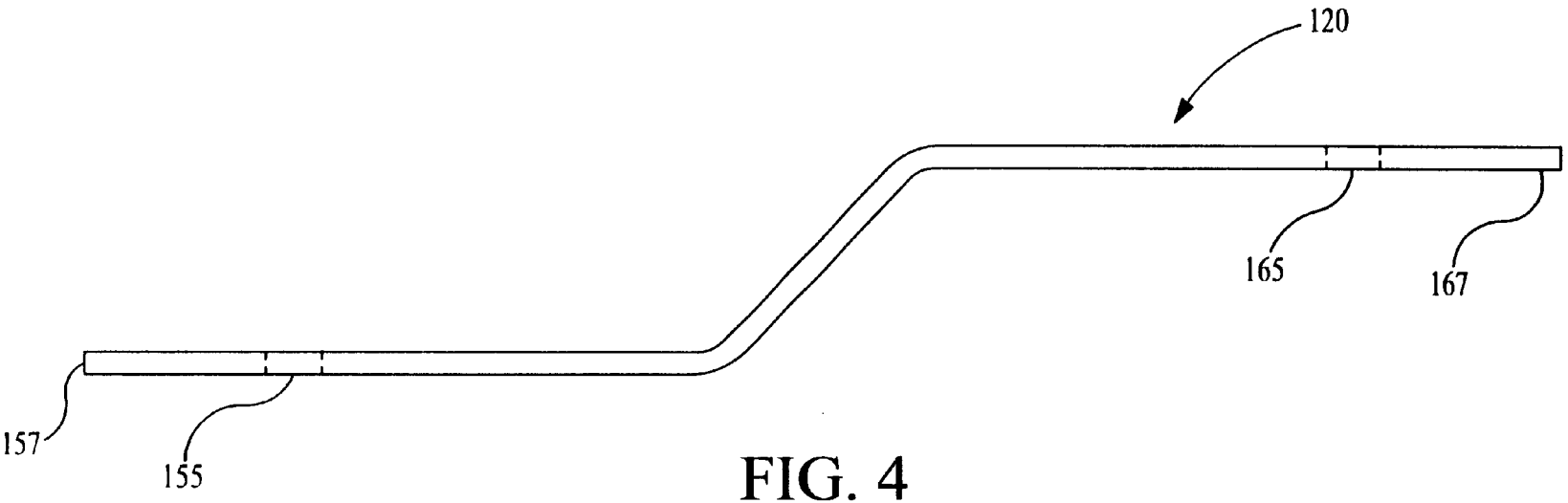
FIGS. 4 and 5 are side and top views of an arm of the fixture of FIG. 1.
Figure 5:
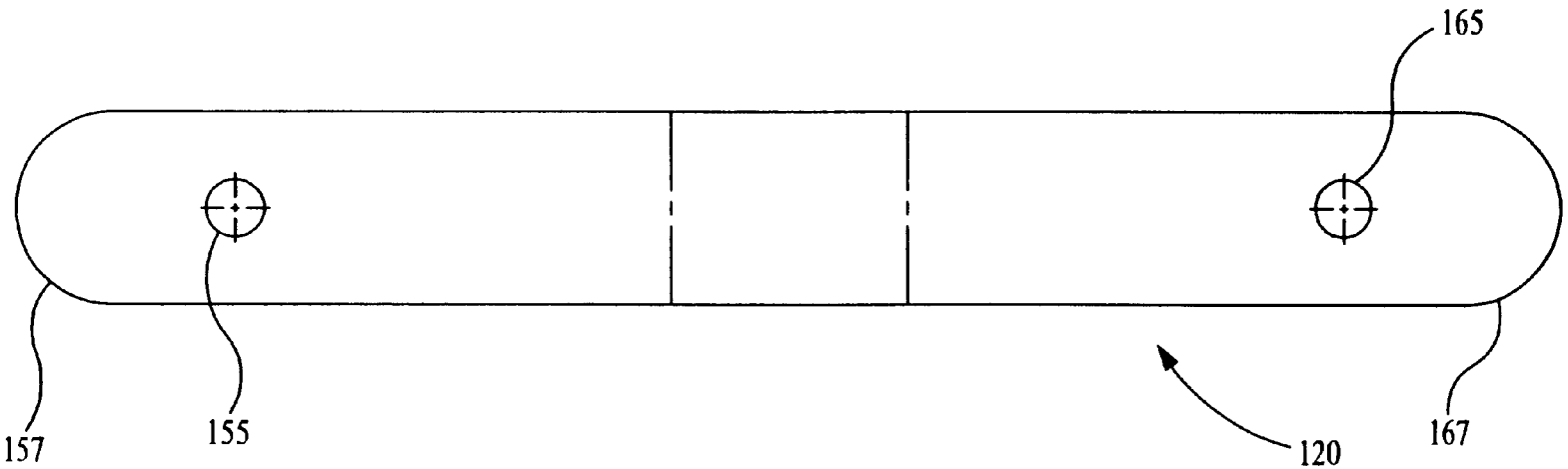

Referring also to FIGS. 4 and 5, the arms 120 are mounted to the aiming base 125 with a pair of bolts 150 that pass through a pair of channels 155 in first ends 157 of the arms 120. The arms 120 rest against a pair of ledges 160 on the base 125. The ledges prevent the arms from rotating relative to the aiming base 125, thereby assuring that the position of arms 120 will remain constant and not affect the aiming of the reflector 105. Each arm 120 also has a second channel 165 at a second end 167 of the arm. A mounting guide 123 is mounted to the second end 167 of an arm 120 by a lamping bolt 170 that extends through the channel 165.

Figure 6:
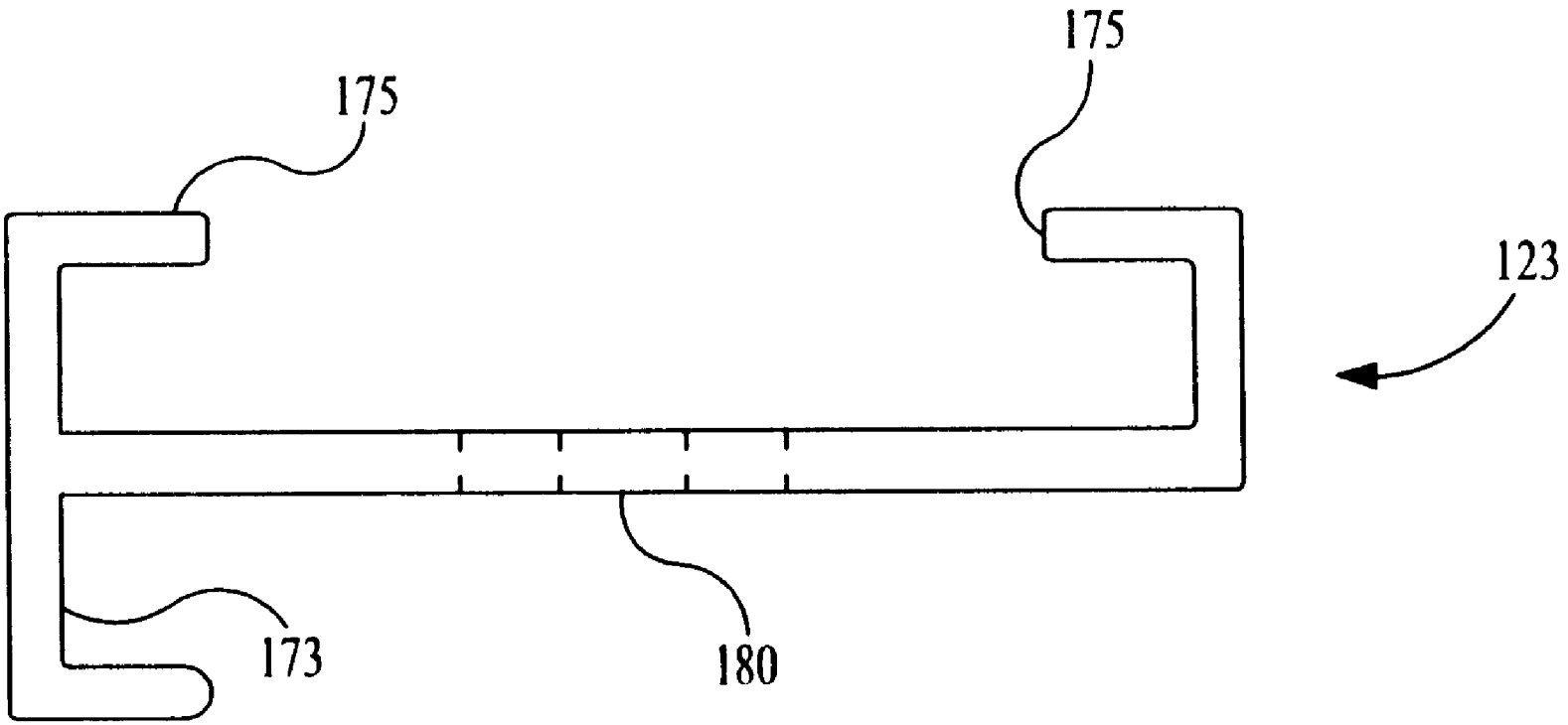
FIG. 6 is an end view of a mounting guide of the fixture of FIG. 1.

Referring to FIG. 6, a mounting guide 123 includes a stop ledge 173 on one side and a pair of brackets 175 on the other side. The brackets 175 slide over and fit around the second end 167 of an arm 120 when the mounting guide 123 is mounted on the arm 120. Lamping bolt 170 passes through a channel 180 in mounting guide 123. The brackets 175 ensure that the position of the mounting guide 123 relative to the arm 120 is constant. The stop ledge 173 ensures that the hinge plate 115 may be moved to a fixed, known position relative to the arm 120 (with the hinge plate abutting the stop ledge) when the fixture is in an aimed position. The hinge plates 115 can be used to move the reflector 105 relative to the arms 120 between an aimed position and a relamping position by loosening the lamping bolts 170 and rotating the reflector about an axis YY passing between the lamping bolts 170.

The aiming base permits rotation of the floodlight fixture 100 about an axis perpendicular to the axis YY of the fastening bolts 170 (i.e., the axis of the connection bolt 127). Thus, the combination of the aiming provided by the aiming base 125 and the rotatable mounting of the sockets 110 to the hinge plates 115 provides aiming in the horizontal and vertical directions.

Figure 7:
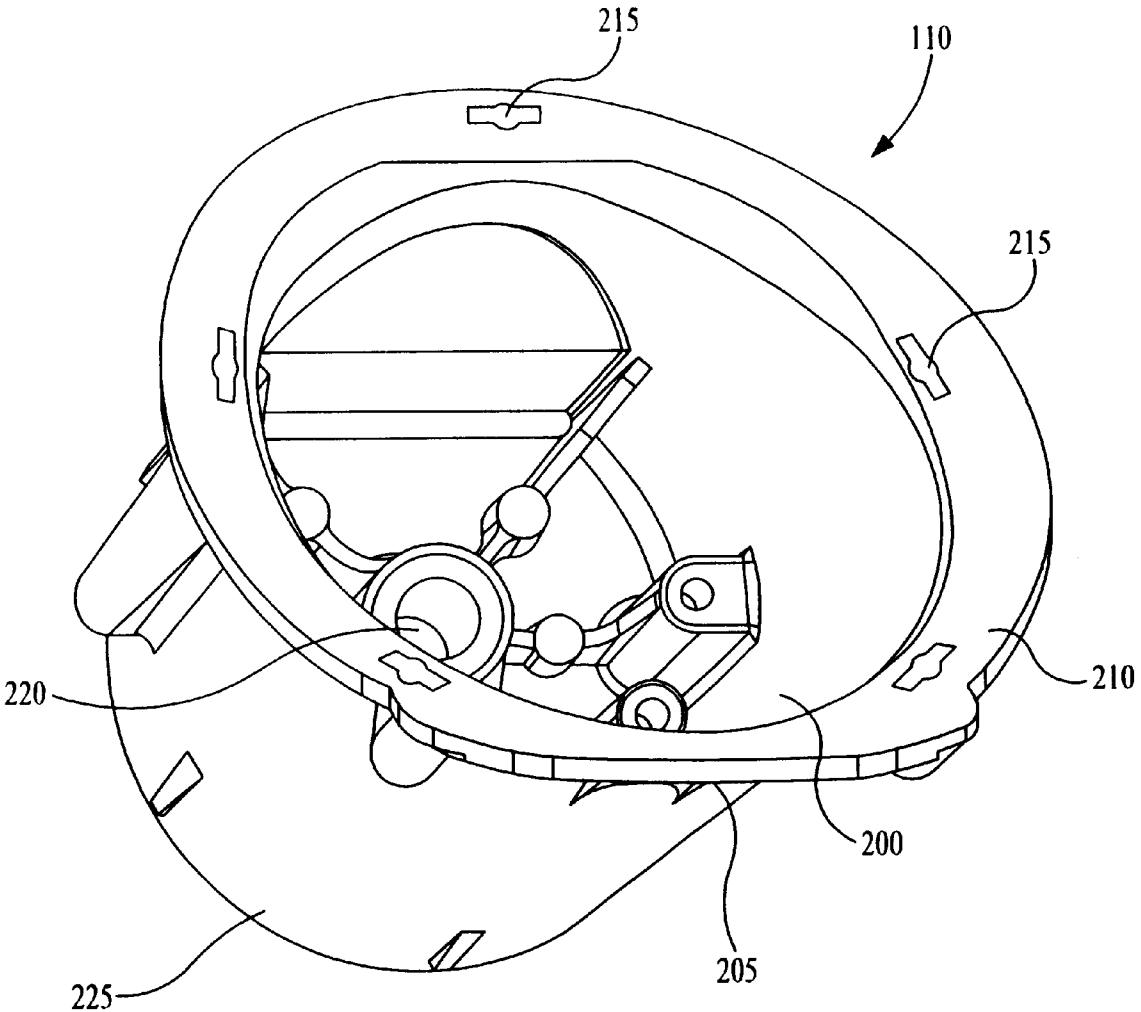
FIG. 7 is a perspective view of a socket of the fixture of FIG. 1.
Figure 8:
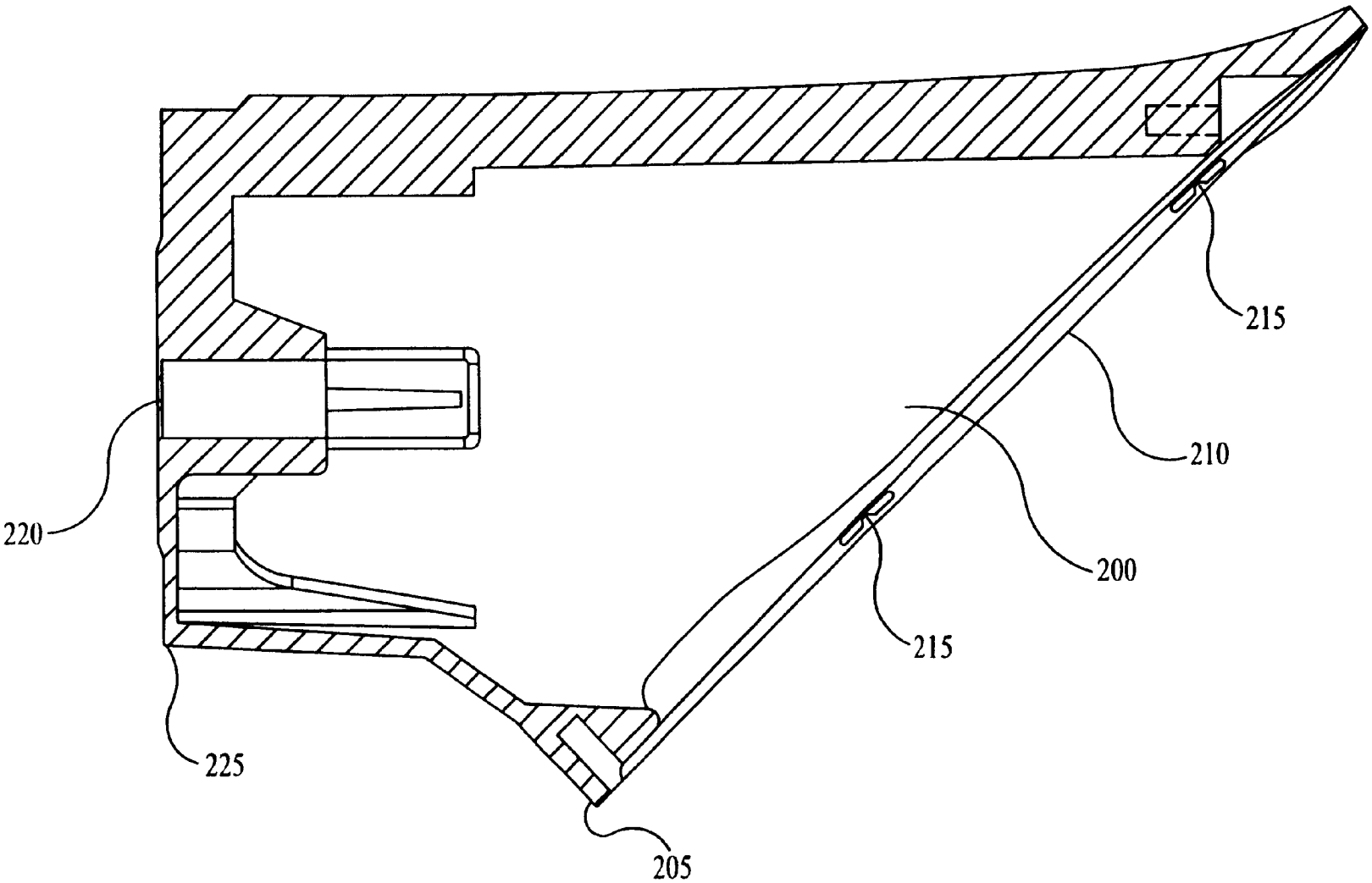
FIG. 8 is a cross-sectional side view of the socket of FIG. 7.

Referring to FIGS. 7 and 8, a socket 110 includes a first opening 200 surrounded at a first end 205 by a flange 210. The flange 210 has, for example, five mounting holes 215 for mounting the socket 110 to the reflector 105. When mounted, the flange 210 is flush with the reflector 105. A gasket, not shown, may be placed between the flange 210 and the reflector 105 to provide a close fit between the socket 110 and reflector. The socket 110 also includes an opening 220 at a second end 225 for receiving an aiming bolt 130.

Figure 9:
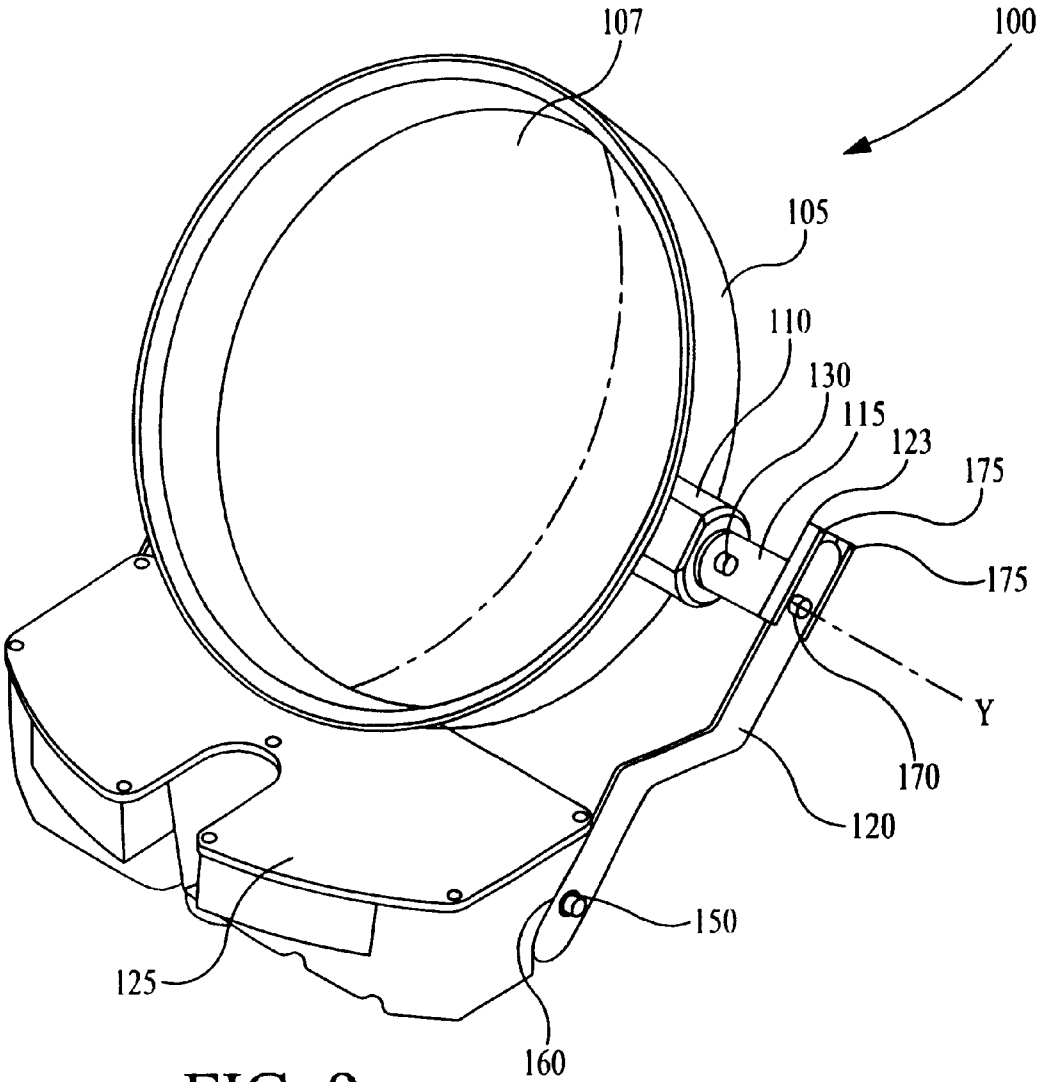
FIG. 9 is a perspective view of the fixture of FIG. 1 in a relamping position.

Referring to FIG. 9, the reflector 105 may be repositioned from the aiming position to a relamping position that is approximately 90 degrees from the aiming position. In this position, the face 107 may be accessed from the rear side of fixture 100 to replace a lamp. To reposition the reflector 105, the lamping bolts 170 are loosened and reflector 105 is rotated about axis YY. After the lamp is replaced, the reflector 105 is returned to the aiming position by rotating the reflector in the opposite direction from which it had been previously rotated until hinge plates 115 rest against stop ledges 173 of mounting guides 123. Bolts 170 then are tightened to secure reflector in place.

In the method of relamping described above, obtaining a repeatable, desired aiming of the floodlight fixture 100 is ensured because the aiming is controlled by the attachment of hinge plates 115 to sockets 110 with aiming bolts 130 and the attachment of arms 120 to aiming base 125 with bolts 150, neither of which is varied during relamping. The interaction between the hinge plates 115 and the stop ledges 173 ensures that the reflector 105 returns to the aimed position after relamping.

Figure 10:
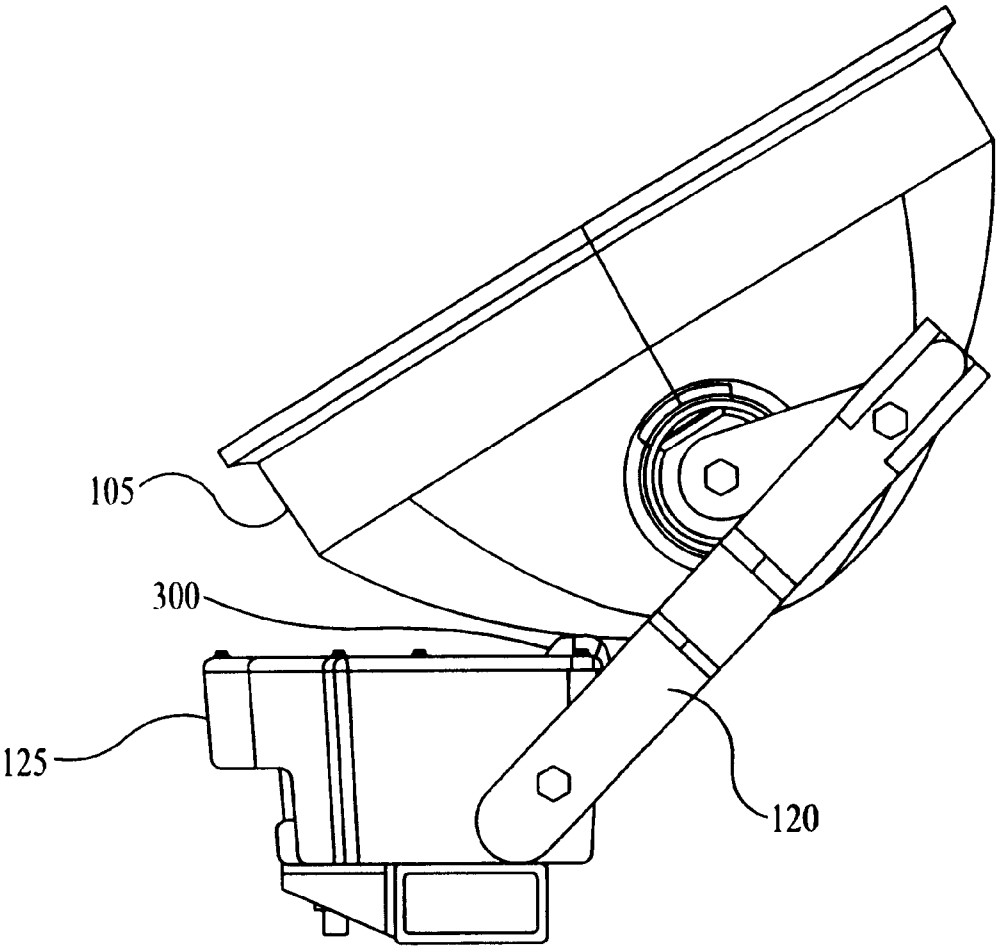
FIGS. 10 and 11 are side and rear views of the fixture of FIG. 1 in a second relamping position.
Figure 11:
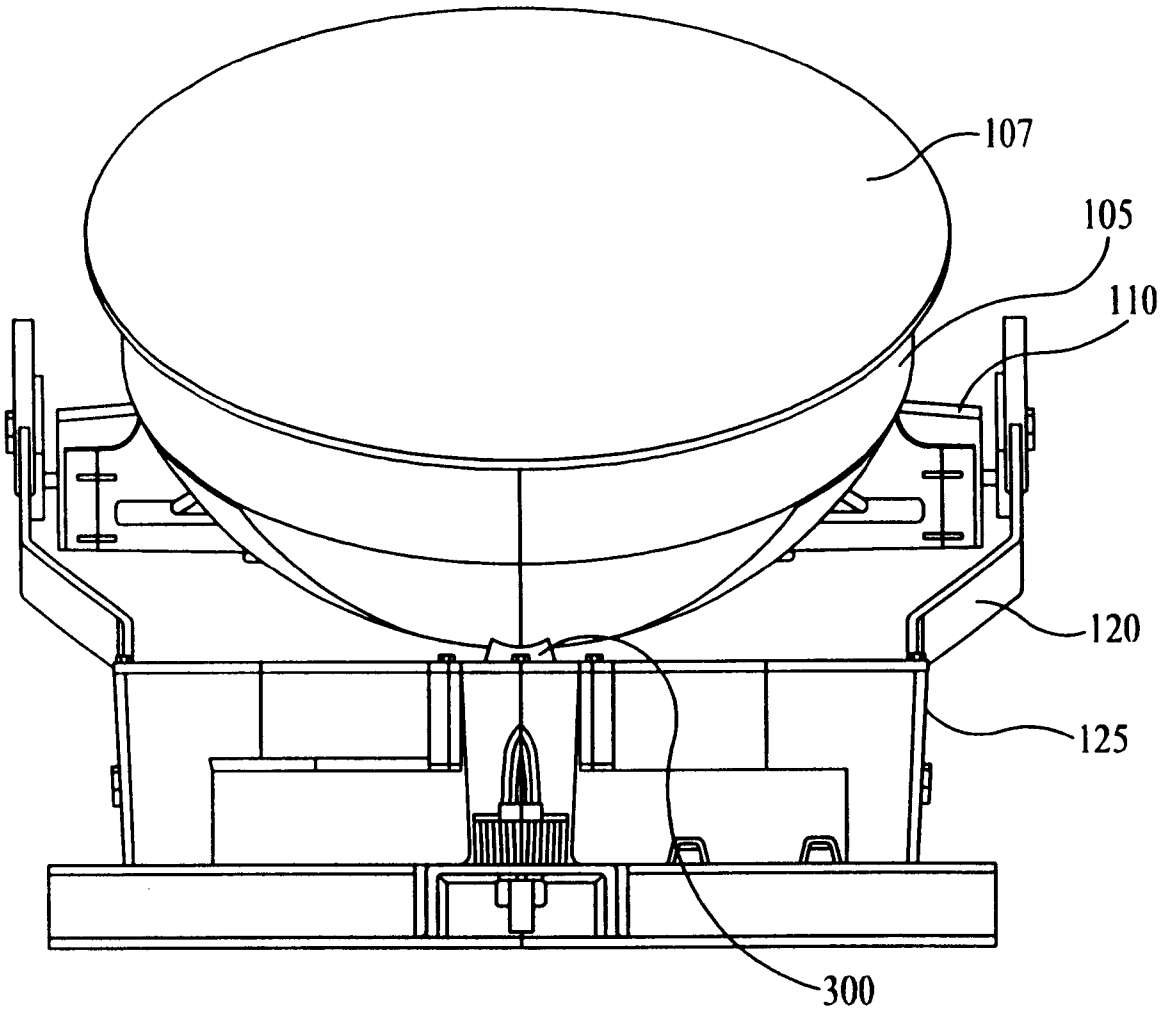

Other embodiments are within the scope of the following claims. For example, referring to FIGS. 10 and 11, aiming base 125 may have a relamping stop 300 against which the reflector 105 sits during relamping. The stop 300 protects the aiming base 125 and reflector 105 from damage when the reflector is being moved to the relamping position.

What is claimed is:

1. A floodlight fixture comprising:

a base;

a reflector assembly;

an aiming mechanism coupled between the base and the reflector assembly, the aiming mechanism permitting movement of the reflector assembly relative to the base to aim the reflector assembly and including a locking mechanism used to fix a configuration of the aiming mechanism; and a relamping mechanism coupled between the base and the reflector assembly, the relamping mechanism permitting movement of the reflector assembly between an aiming position and a relamping position without manipulating the locking mechanism to affect the configuration of the aiming mechanism, wherein the relamping mechanism comprises at least one hinge plate and at least one mounting guide comprising a plate having a stop ledge perpendicular to the plate, wherein a first end of the hinge plate is rotatably connected to the mounting guide.

2. The floodlight fixture of claim 1, wherein a second end of the hinge plate is rotatably connected to the reflector assembly by an aiming bolt.

3. The floodlight fixture of claim 1, wherein the mounting guide is connected to a first end of an arm and a second end of the arm is connected to the base so that a position of the arm relative to the base is fixed.

4. The floodlight fixture of claim 3, wherein the relamping mechanism further comprises a second hinge plate connected to a second mounting guide, and the second mounting guide is connected to a first end of a second arm and a second end of the second arm is connected to the base.

5. The floodlight fixture of claim 3, wherein the mounting guide further comprises a pair of brackets mounted perpendicularly to the plate and positioned on a side opposite from the stop ledge and the brackets surround a portion of the arm.

6. The floodlight fixture of claim 5, wherein the mounting guide is connected to the hinge plate and arm by a lamping bolt that is loosenable to permit moving the reflector assembly between the aimed position and the relamping position.

7. The floodlight fixture of claim 5, wherein the brackets is configured to fix the position of the mounting guide relative to the arm.

8. The floodlight fixture of claim 1, wherein the hinge plate rests against the stop ledge in the aiming position.

9. The floodlight fixture of claim 1, wherein the relamping mechanism is configured to permit the rotation of the hinge plate in one direction when the hinge plate rests against the stop ledge.

10. The floodlight fixture of claim 1, wherein a position of the reflector assembly relative to the hinge plate is the same in the aiming position and the relamping position.

11. The floodlight fixture of claim 1, wherein the reflector assembly comprises a reflector and the aiming mechanism, and the aiming mechanism includes at least one socket.

12. The floodlight fixture of claim 11, wherein the aiming mechanism further comprises an aiming sight comprising a slot and a tab mounted on the socket.

13. The floodlight fixture of claim 11, wherein the locking mechanism comprises at least one aiming bolt and the aiming bolt passes from a second end of the hinge plate into the socket.

14. A method of changing a lamp in a floodlight fixture comprising:

providing a floodlight fixture comprising (a) a base; (b) a reflector assembly; (c) an aiming mechanism coupled between the base and the reflector assembly, the aiming mechanism permitting movement of the reflector assembly relative to the base to aim the reflector assembly and including a locking mechanism used to fix a configuration of the aiming mechanism; and (d) a relamping mechanism coupled between the base and the reflector assembly, the relamping mechanism permitting movement of the reflector assembly between an aiming position and a relamping position without manipulating the locking mechanism to affect the configuration of the aiming mechanism;

moving the reflector assembly from the aiming position to the relamping position;

changing the lamp; and returning the reflector assembly to the aiming position, wherein the position of the relamping mechanism relative to the reflector assembly in the aiming position is the same after relamping as it was before relamping, wherein the relamping mechanism comprises at least one hinge plate and at least one mounting guide comprising a plate having a stop ledge perpendicular to the plate, wherein a first end of the hinge plate is rotatably connected to the mounting guide and in the aiming position the hinge plate rests against the stop ledge, and returning the reflector assembly to the aiming position comprises resting the hinge plate against the stop ledge.

15. The method of claim 14, wherein the mounting guide is connected to the hinge plate and arm by a lamping bolt that is loosenable to permit moving the reflector assembly from the aiming position and the relamping position.

16. The method of claim 14, wherein the position of the reflector assembly in the aiming position is the same after relamping as it was before relamping.

17. A method of changing a lamp in a floodlight fixture comprising:

providing a floodlight fixture comprising (a) a base; (b) a reflector assembly; (c) an aiming mechanism coupled between the base and the reflector assembly, the aiming mechanism permitting movement of the reflector assembly relative to the base to aim the reflector assembly and including a locking mechanism used to fix a configuration of the aiming mechanism; and (d) a relamping mechanism coupled between the base and the reflector assembly, the relamping mechanism permitting movement of the reflector assembly between an aiming position and a relamping position without manipulating the locking mechanism to affect the configuration of the aiming mechanism;

moving the reflector assembly from the aiming position to the relamping position;

changing the lamp; and returning the reflector assembly to the aiming position, wherein the position of the relamping mechanism relative to the reflector assembly in the aiming position is the same after relamping as it was before relamping, wherein the reflector assembly comprises a reflector and the aiming mechanism, and the aiming mechanism includes at least one socket.

18. The method of claim 17, wherein the locking mechanism comprises at least one aiming bolt and the aiming bolt passes from a first end of the relamping mechanism into the socket and aiming the reflector assembly comprises loosening the aiming bolt, aiming the reflector assembly, and retightening the aiming bolt to fix the reflector in the aiming position.

19. The method of claim 18, wherein the aiming mechanism further comprises an aiming sight including a slot and a tab, the aiming sight is mounted on the socket, and aiming the reflector assembly further comprises visually fitting the tab in the slot.

20. The method of claim 17, wherein the position of the reflector assembly in the aiming position is the same after relamping as it was before relamping.

* * * * *